United States Patent [19]

Ralph

[11] 4,096,660

[45] Jun. 27, 1978

[54] BALLOON POWERED AIRPLANE

[76] Inventor: William H. Ralph, 301 N. Blackman Ave., Duluth, Minn. 55811

[21] Appl. No.: 719,852

[22] Filed: Sep. 2, 1976

[51] Int. Cl.[2] ..... A63H 27/06

[52] U.S. Cl. ..... 46/76 A; 46/89

[58] Field of Search ..... 46/76 A, 89

[56] References Cited

U.S. PATENT DOCUMENTS

| | | | |
|---|---|---|---|
| 1,765,435 | 6/1930 | McBride | 46/89 |
| 2,384,193 | 9/1945 | Platt | 46/76 A |
| 2,505,526 | 4/1950 | Costea | 46/89 |
| 3,229,417 | 1/1966 | Stanzel | 46/76 A |

*Primary Examiner*—F. Barry Shay

*Attorney, Agent, or Firm*—Wicks & Nemer

[57] ABSTRACT

A balloon powered toy airplane including a one piece stick fuselage having a wing mounted thereon and a stabilizer and fin also mounted thereon. A balloon inflatable at one end with the other closed end secured to the fuselage. Secured to and depending from the fuselage is a loop through which the balloon extends in alignment with the fuselage. With the balloon inflated and released the airplane flies as a result.

1 Claim, 6 Drawing Figures

FIG. 1
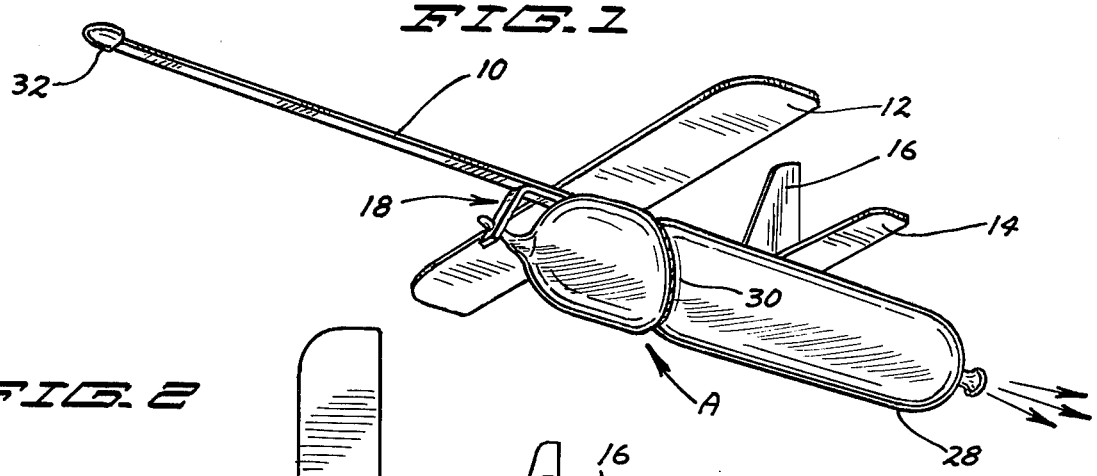
FIG. 2
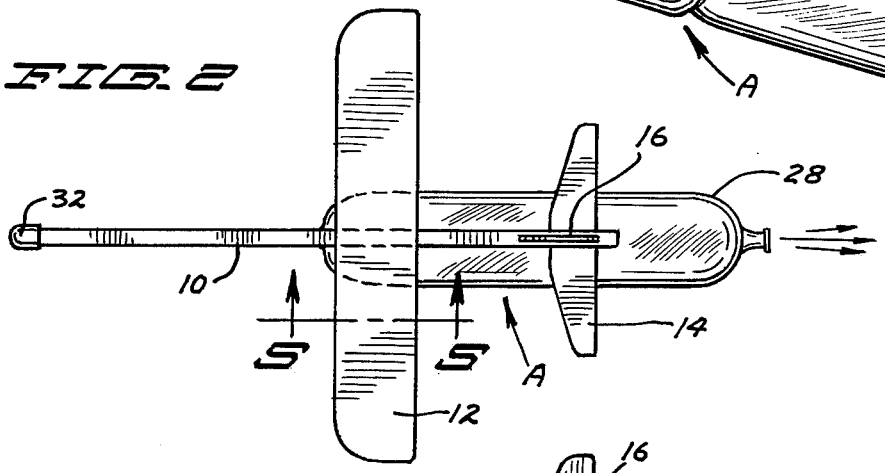
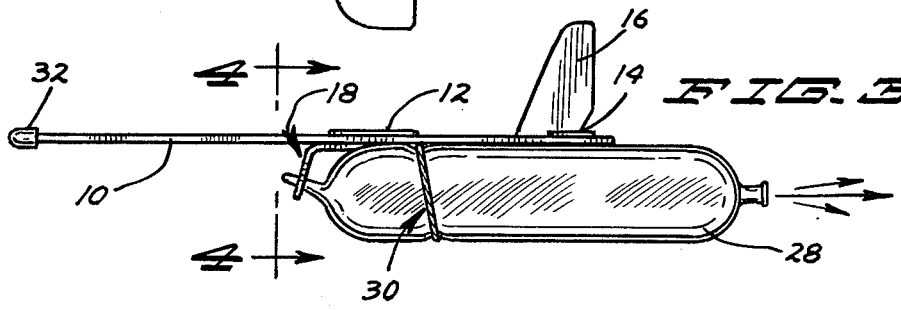
FIG. 3
FIG. 5
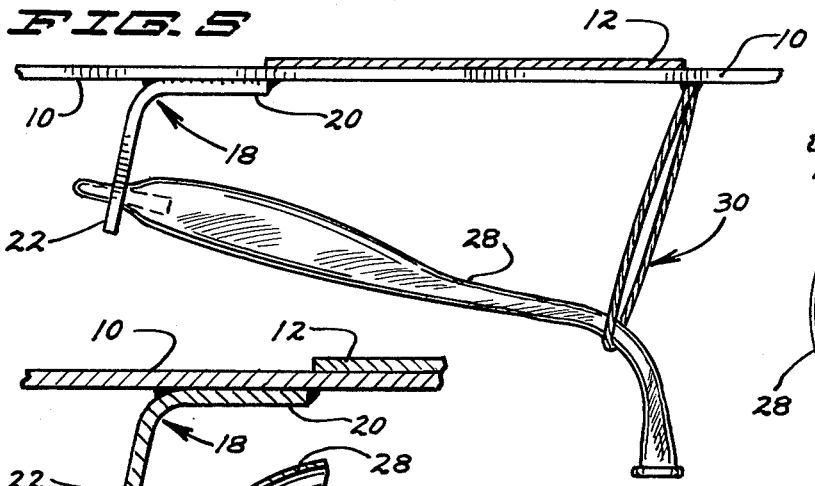
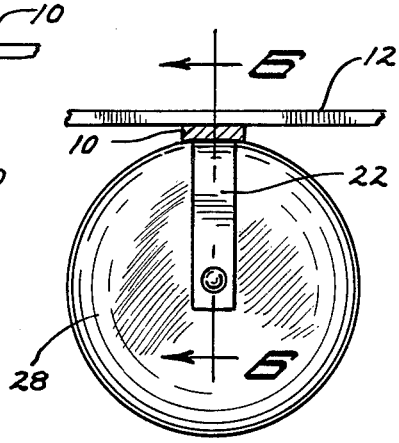
FIG. 4
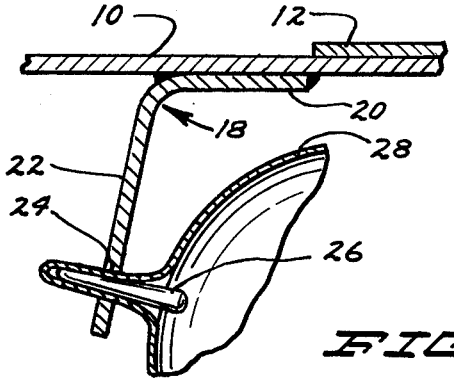
FIG. 6

BALLOON POWERED AIRPLANE

SUMMARY

The invention relates to an improvement in hand launched toy airplanes and more particularly to a plane having a simple fuselage, wing, stabilizer, and fin which is easy to assemble and is relatively economical. It is a feature of the invention to provide a means of propulsion of the plane which includes a conventional elongated balloon secured at its closed end to the underside of the fuselage with the inflatable open end to the rear of the plane.

It is a further feature to provide a loop depending from the fuselage and through which the balloon extends in deflated condition so that when the balloon is inflated it is held in alignment with the fuselage and when released the thrust of air from the balloon powers the plane in flight.

In drawings forming part of this application:

FIG. 1 is a perspective view of a balloon powered toy airplane in flight embodying the invention.

FIG. 2 is a top plan view thereof.

FIG. 3 is a side elevational view.

FIG. 4 is a view on the line 4—4 of FIG. 3.

FIG. 5 is an enlarged detailed view on the line 5—5 of FIG. 2 but with the balloon deflated.

FIG. 6 is a sectional view on the line 6—6 of FIG. 4.

Referring to the drawings in detail the balloon powered toy airplane A includes the elongated stick fuselage 10. Secured to the elongated fuselage 10 substantially centrally thereof is the wing 12. The wing is secured by conventional means such as glue, screws, or the like. The numeral 14 designates a rear stabilizer which is secured to the fuselage adjacent the rear end thereof. Further provided is the fin 16 secured to the fuselage adjacent the stabilizer by means of glue or in a slot in the fuselage.

The numeral 18 designates a balloon support which includes the base portion 20 which terminates in the substantially right angular disposed arm 22. The arm 22 is formed with the hole 24 and the base portion 20 is secured to the underside of the fuselage 10 at a point just forward of the leading edge of the wing by glue, screws, or the like so that the arm 22 depends downwardly from the fuselage. Further provided is the tapered peg 26 which is inserted inside the balloon 28 to the closed end when the balloon is deflated, particularly FIGS. 5 and 6. The diameter of the balloon is less than the length thereof when inflated. The peg 26 with the balloon 28 thereon is then jammed into the hole for a press fit thereby mounting the closed end of the balloon extended rearwardly and the body of the balloon generally parallel to and in a position below the fuselage.

The numeral 30 designates a balloon guide which is a loop of substantially flexible material such as cord, plastic, or the like and of a diameter such that it will receive the balloon when it is inflated, particularly FIGS. 1 - 3. The loop 30 is connected to the fuselage at a point space rearwardly from support 18 and with the balloon held in alignment with the fuselage it will propel the airplane forwardly in substantially a straight line. Secured to the forward end of the fuselage is the rubber tip 32 which provides ballast and eases impact. The flight attitude of the plane can be controlled by the size and weight of the tip 32.

The size of the airplane would be determined by size and thrust of the balloon used and can be made of plastic, wood, or the like. It will be seen that with the peg 26 and hole 24 in the support 18 for engagement of the balloon with the support, that a balloon may be easily attached, removed, and replaced.

In using the airplane, the balloon 28 is secured to the fuselage as set forth above and extended through the guide 30 to hold the balloon in line with the fuselage. The balloon is then inflated as in FIGS. 1, 2, and 3 while holding the airplane. When the balloon is inflated, the airplane is let go and it performs a powered flight.

Having thus described the invention, what is claimed as new and desired to be secured by Letters Patent is:

1. A toy balloon powered toy airplane comprising:

(a) a fuselage formed by a single piece rectilinear member and having, (b) a wing secured thereto, (c) a stabilizer mounted on said fuselage, (d) a fin mounted on said fuselage, (e) a balloon inflatable at one end thereof, (f) means for securing the other end of the balloon to said fuselage adjacent said wing, and (g) a loop connected to and depending from said fuselage and at a right angle thereto and through which said balloon extends for holding said balloon in alignment with said fuselage with said one end in position to power the airplane by expulsion of the balloon contents, said means for securing the other end of the balloon to the fuselage including (h) a support connected to the fuselage, (i) said support having a hole therein, (j) a peg for placement within said balloon and for forcing a portion of the balloon into said hole and for retaining it in frictional engagement with the edge thereof.

* * * * *